US011197545B2

(12) United States Patent
Trombettoni et al.

(10) Patent No.: US 11,197,545 B2
(45) **Date of Patent: *Dec. 14, 2021**

(54) CABINET WITH PULL-OUT SHELVES AND RELATED PULL-OUT MECHANISM

(71) Applicant: INOXA SRL, Polverigi (IT)

(72) Inventors: Roberto Trombettoni, Polverigi (IT); Emanuele Silvi, Polverigi (IT)

( * ) Notice: Subject to any disclaimer, the term of this patent is extended or adjusted under 35 U.S.C. 154(b) by 0 days.

This patent is subject to a terminal disclaimer.

(21) Appl. No.: 16/622,935

(22) PCT Filed: Jun. 18, 2018

(86) PCT No.: PCT/IT2018/050108

§ 371 (c)(1),
(2) Date: Dec. 16, 2019

(87) PCT Pub. No.: WO2018/235116

PCT Pub. Date: Dec. 27, 2018

(65) Prior Publication Data

US 2021/0145170 A1 May 20, 2021

(30) Foreign Application Priority Data

Jun. 22, 2017 (IT) ..... 102017000069780

(51) Int. Cl.
*A47B 77/10* (2006.01)
*A47B 49/00* (2006.01)

(52) U.S. Cl.
CPC ..... *A47B 77/10* (2013.01); *A47B 49/004* (2013.01)

(58) Field of Classification Search
CPC ..... A47B 49/00; A47B 49/004; A47B 49/006; A47B 77/10; A47B 81/002
(Continued)

(56) References Cited

U.S. PATENT DOCUMENTS 4,582,372 A * 4/1986 Cooper ..... A47B 46/00 108/140
4,959,582 A * 9/1990 Meyer ..... E05D 15/36 16/358

(Continued)

FOREIGN PATENT DOCUMENTS

EP 2092850 * 8/2009 ..... A47B 49/00

*Primary Examiner* — James O Hansen
(74) *Attorney, Agent, or Firm* — Patshegen IP LLC; Moshe Pinchas

(57) ABSTRACT

A cabinet (1) with a containment space (2), shelves (9) contained in the containment space (2), an access opening (3) to the containment space (2) and a moving mechanism (4) for moving the shelves (9) through the opening (3); wherein the moving mechanism (4) comprises a first arm (5) and a second arm (6), which are sustained by the cabinet (1), cantilever-style, inside the containment space (2), and rotatably about a vertical line (V), said first arm (5) and second arm (6) in turn sustaining a related shelf (9) in a condition rotatable with a turning motion about at least one vertical line (V). At least the second arm (6) of said arms (5, 6) is provided with two component segments (10, 11), converging at an interposed articulated joint (12). Control means (13) for coordination of the motion of the first arm (5) and the second arm (6) which are designed to allow the shelf (9) to travel along a horizontal trajectory with variable orientation of its positioning, in such a way as to pass through the access opening (3) of the cabinet (1). The control means (13) comprise a slider (14) and a track (16) relative to which the slider (14) is movable. The slider (14) and the track (16) are as one, constantly coupled to one another, and operatively positioned between said first arm (5) and second arm (6).

9 Claims, 3 Drawing Sheets

(58) Field of Classification Search
USPC ..... 312/238, 307
See application file for complete search history.

(56) References Cited

U.S. PATENT DOCUMENTS

| | | | | | |
|---|---|---|---|---|---|
| 5,658,772 | A * | 8/1997 | Odell | C07K 14/32 | 435/320.1 |
| 8,020,951 | B2 * | 9/2011 | Twellmann | A47B 81/002 | 312/238 |
| 2006/0012273 | A1 * | 1/2006 | Kreyenkamp | A47B 81/002 | 312/238 |
| 2007/0262682 | A1 * | 11/2007 | Gunter | A47B 81/002 | 312/238 |
| 2010/0084952 | A1 * | 4/2010 | Sagel | A47B 46/00 | 312/238 |
| 2012/0049708 | A1 * | 3/2012 | Kopnick | A47B 81/002 | 312/238 |
| 2014/0225492 | A1 * | 8/2014 | Kreyenkamp | A47B 81/002 | 312/238 |

* cited by examiner

CABINET WITH PULL-OUT SHELVES AND RELATED PULL-OUT MECHANISM

TECHNICAL FIELD

This invention relates to a cabinet with shelves that can be pulled out of a containment space and positioned outside the cabinet and vice versa can be put back in it. A pull-out mechanism is also part of the invention.

BACKGROUND ART

When constructing furniture and in particular corner cabinets, which may have a modular structure, a known method for solving the problem of poor access to the inner compartment of the furniture through its door is to make the shelves such that they can be pulled out for use and then put back in.

In fact, that allows the user to access and use the shelf in total comfort, without encountering any obstacles, and then put the shelf, along with the objects supported, back in the containment space inside the piece of furniture when he or she has finished handling the objects.

The movements of pulling out and putting back in the shelf through the access opening of the piece of furniture affect both the shape of the outline of the shelf and the trajectory that the shelf has to follow in order to: come out of the containment space of the piece of furniture, reach the outside of the piece of furniture, and go back into it during the reverse movement.

The trajectory and the shape are interdependent, since they affect each other. In fact, the trajectory influences the shape of the shelf and the extent of its usable surface, intended to support the objects inside a containment cabinet.

In terms of shape, semi-circular shelves have proved able to provide a satisfactory compromise between usable surface and easy transit without obstacles through the access opening of the piece of furniture.

In fact, the substantially semi-circular shape makes available a quite satisfactory loading surface, although smaller than the square and/or rectangular shapes of similar fixed shelves. As regards the ability of this shape to pass through the door, tests have shown that this can be achieved with a movement on a substantially sinusoidal trajectory, that allows the semi-circular shelf to get around first one and then the other of the two vertical edges that delimit the door.

A first embodiment of mechanisms suitable for giving the shelf this movement, known from document US2006/0012273, comprises a supporting column with a vertical axis of rotation that is positioned inside the containment space of the piece of furniture and behind one of the posts of the door, and a hinge with vertical axis supported behind the other post by one side of the piece of furniture. Projecting horizontally from the column and from the hinge cantilever-style there are two arms that can rotate independently and oscillate angularly about the respective vertical axes of rotation. The two arms in combination support the shelf at two separate points of it. By rotation of the two arms in opposite directions about the column and the hinge, the semi-circular shelf can be practically completely pulled out of the containment space of the piece of furniture, and vice versa put back into it with inverted movements.

Another solution described and illustrated by document EP 2415370 again comprises a column positioned inside the containment compartment, supporting cantilever-style an "L"-shaped bracket, that is horizontally rotatable about the column, and that sustains a curved guide on which a trolley is mounted, in turn supporting the shelf. Rotation of the "L"-shaped bracket about the column, appropriately followed by translation of the trolley along the guide, allows the shelf to gradually travel along the trajectory, being oriented along it in such a way that it can come out through the door, to the outside of the containment space of the piece of furniture and then be put back into it with a reverse movement.

The fundamental disadvantage of prior art solutions is that they need the vertical supporting column of the mechanism inside the piece of furniture.

That component involves several disadvantages.

In fact, first, it takes up valuable shelf space compared with the total usable space which would otherwise be provided inside the piece of furniture by a fixed shelf. Second, it is not aesthetically pleasing, above all when the structure of the piece of furniture is such that it does not have a door post with a vertical member behind which the column can be concealed.

Another disadvantage is the fact that the mechanism for moving the shelf has quite large dimensions in plan view inside the containment compartment of the piece of furniture. In fact, it covers practically the entire horizontal dimensions of the door opening, extending from one of its doorposts to the other.

A further disadvantage of the prior art solutions is the fact that when fully pulled out the semi-circular shelf has a more or less oblique positioning relative to its main axes, meaning relatively large dimensions in front of and outside the cabinet. Therefore, in front of the cabinet there has to be enough free space to allow the progress of the shelf movement.

A prior art technical solution proposed by the same Applicant and described in document IT 102016000128318 overcomes the above-mentioned disadvantages with a solution having a shelf having an essentially sinusoidal, two-lobe shape, basically defined by two segments which are substantially semi-circular in opposite directions, which are cut at the opposite ends of the shelf by two substantially straight stretches roughly parallel with a pair of vertical walls of the cabinet. The pull-out shelf is moved by a shelf movement control mechanism which basically comprises two movable sliders and two tracks, the sliders one at a time cyclically coming out of and going back into the tracks according to a suitable sequence of movements.

DISCLOSURE OF THE INVENTION

That solution brilliantly got around the disadvantages of the prior art. However, it has aspects which can potentially be improved upon, which are a specific technical purpose of this invention.

Within the scope of that technical purpose a first aim of the invention therefore relates to the search for a shelf shape which—although subject to the limitations related to the kinematics of coming out of and going back into the containment space—has a larger usable surface than the previous prior art solutions, the dimensions of the containment space of a cabinet of preset dimensions, intended to receive the movable shelf, being equal.

A second aim of the invention is to devise a structure of the shelf movement control means which is simpler and less expensive to make, and which is more mechanically reliable, guaranteeing a long product working life. According to the invention, those results are achieved by means of a cabinet equipped with pull-out shelves and a pull-out mechanism, whose technical features are described in one or more of the appended claims.

BRIEF DESCRIPTION OF THE DRAWINGS

The advantages of the invention are more apparent in the detailed description which follows, with reference to the accompanying drawings which illustrate an example, non-limiting embodiment of the invention, in which.

DETAILED DESCRIPTION OF PREFERRED EMBODIMENT OF THE INVENTION

Figure 1:
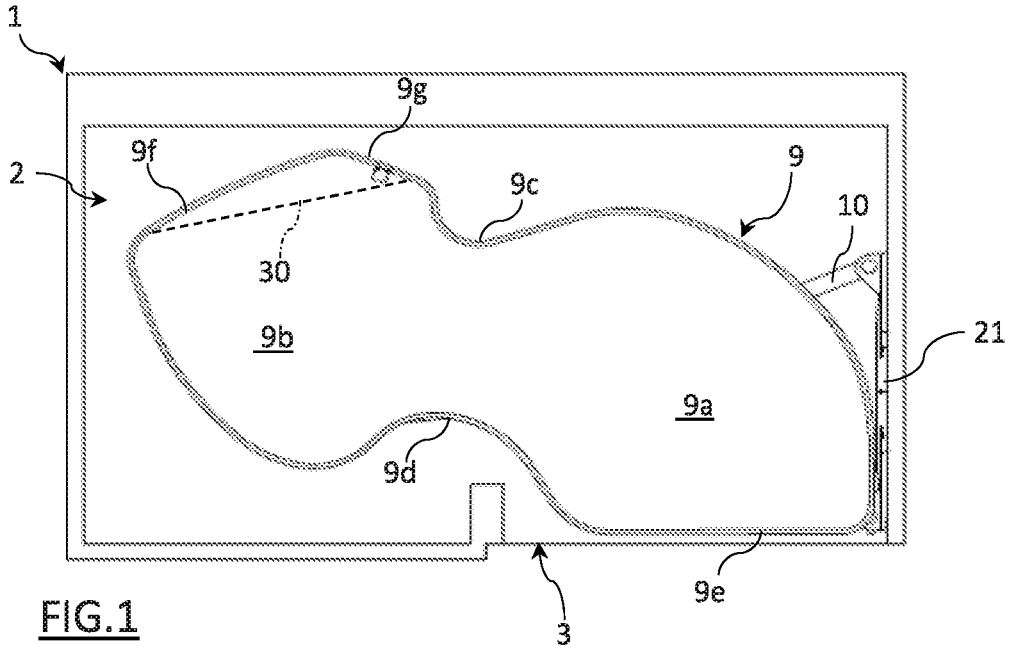
FIG. 1 is a top plan assembly view of the invention, illustrated with a pull-out shelf completely contained in the containment space of a generic cabinet.

With reference to the figures of the accompanying drawings, in FIG. 1 the numeral 1 denotes in its entirety a generic cabinet provided with a containment space 2 equipped with horizontal shelves 9 for supporting objects.

The shelves 9 can be pulled out of the containment space 2 through an access opening 3, to be positioned outside the cabinet 1, in a location near a user of the cabinet 1 where access to the usable surface of the shelf 9 is more convenient, and vice versa, can be put back into the containment space 2 of the cabinet 1 when operations are complete.

More particularly, FIG. 1 shows how the shelf 9 has an oblong, two-lobe, basically sinuous shape, which comprises two lobes 9*a*, 9*b* in a monolithic structure, consisting of two flat parts having the shape of irregular circular sectors, with mixtilinear outlines, which comprise curved edge stretches with curvatures in opposite directions. The lobes 9*a*, 9*b* are monolithically joined to one another, in a zone between the two, by curved connections 9*c*, 9*d*.

The shelf 9 has end edges 9*e*; 9*f*, 9*g*, one 9*e* of which is basically straight, the other in contrast being multi-sided, composed of at least two consecutive straight sides 9*f*, 9*g*.

In the figures reference will be made to a cabinet 1 layout having only one shelf 9. That is purely to keep the description simple, it being obvious that the cabinet 1 may be equipped with a more or less numerous set of shelves 9, stacked vertically and appropriately spaced from each other.

Regarding the access opening 3 to the containment space 2, hereinafter in the description generic reference will be made to a door opening, it being understood that—as will be clarified below—the physical presence or absence of a door is of no importance to the invention described.

FIG. 2, and FIGS. 3 to 6 even more so, show how, for moving the shelf 9, the cabinet 1 is provided with a moving mechanism, labelled 4 as a whole.

That mechanism 4 basically comprises (FIG. 3) a first arm 5 and a second arm 6, sustained by the same vertical side 7 of the cabinet 1, cantilever-style and horizontally, in the containment space 2.

The arms 5 and 6 are rotatable together, in a horizontal plane, about a vertical line V of free movement, allowed by respective fixed cylindrical hinges 23 and 22, constraining the arms 6 and 7 and supported by an anchoring member 21 that anchors the mechanism 4 to the side 7 of the cabinet 1.

Figure 3:
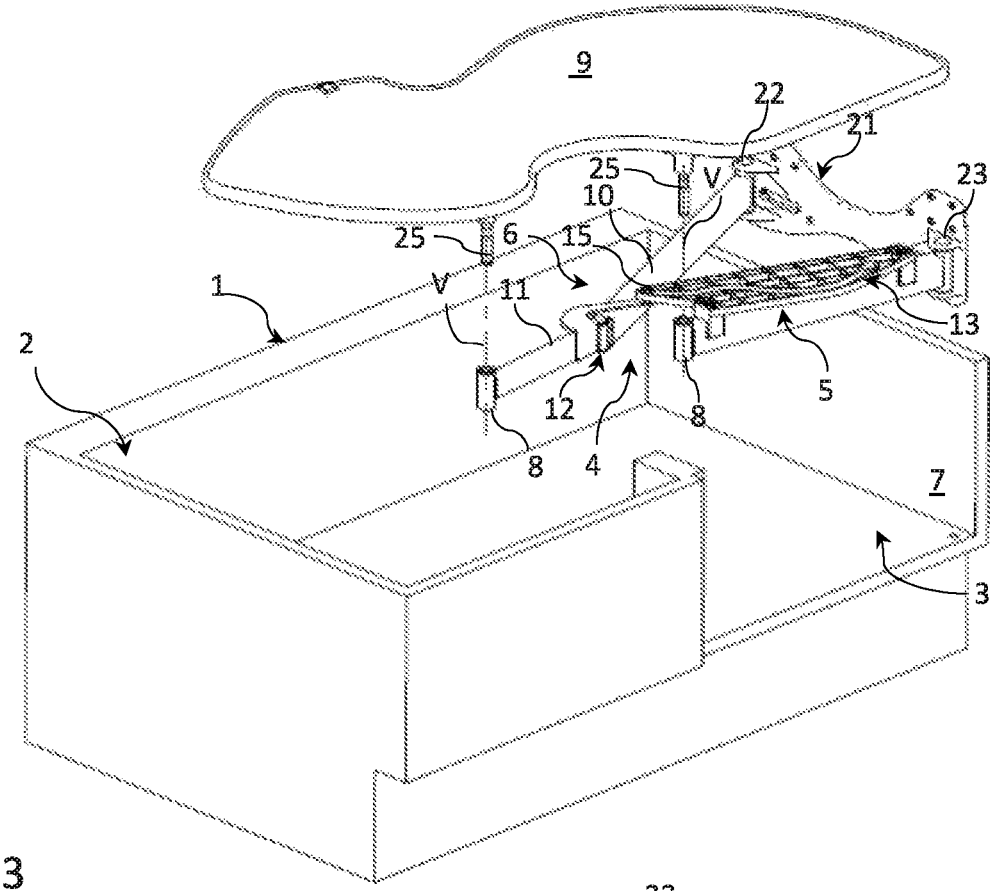
FIG. 3 is an exploded perspective view, showing the cabinet, the shelf and the related pull-out mechanism in the state of FIGS. 1 and 2.

FIG. 3 shows that the first arm 5 and the second arm 6 in turn sustain, at their free ends, a related shelf 9 in a condition in which it can rotate, freely turning about the vertical line V. In particular, it should be noticed in FIG. 3 that the shelf 9 is provided with pins 25 supported jutting vertically, cantilever-style, which axially engage in cylindrical seats 8 supported at one end of the arms 5, 6.

More particularly, the first arm 5 comprises a monolithic tubular rod, which at its opposite ends is connected: on one side to the fixed hinge 23; and which on the opposite side sustains the shelf 9.

In contrast, the second arm 6 has a composite, articulated structure, in the horizontal plane, comprising two straight segments 10, 11 that converge and are joined to each other at an interposed articulated joint 12. One end of the first segment 10 is rotatably interconnected to one 22 of the two fixed cylindrical hinges of the anchoring member 21. In contrast, the free end of the second segment 11 supports the other seat 8 for the corresponding pin 25 of the shelf 9.

Operatively positioned between the first arm 5 and the second arm 6, the mechanism 4 comprises control and guiding means 13 for controlling and guiding the synchronised coordinated movement of the two arms 5 and 6 and of the pull-out shelf 9.

Thanks to those control and guiding means 13, the shelf is movable horizontally and along a translating trajectory. Moreover, it has an angularly variable positioning in terms of its orientation about the vertical line V, which allows the above-mentioned shelf 9 to pass without interference through the access opening 3 to the containment space 2 of the cabinet 1.

Figure 4:
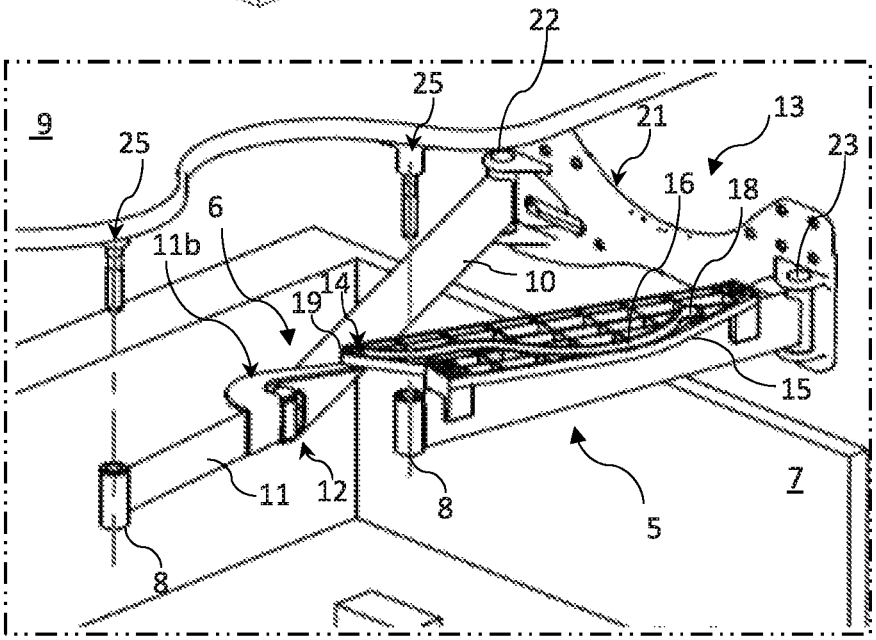
FIG. 4 is an enlarged partial view of a detail of FIG. 3, with some parts cut away to better illustrate others.

More particularly, FIG. 4 shows how the control means 13 comprise a single slider 14 supported by an arm 11*b* of the second segment 11 of the jointed arm 6, and a track 16, made in a plate 15 that is supported by and fixed to the first arm 5.

In the track 16 the slider 14 is constantly engaged and constrained, with relative rotating and translating freedom of movement.

Figure 5:
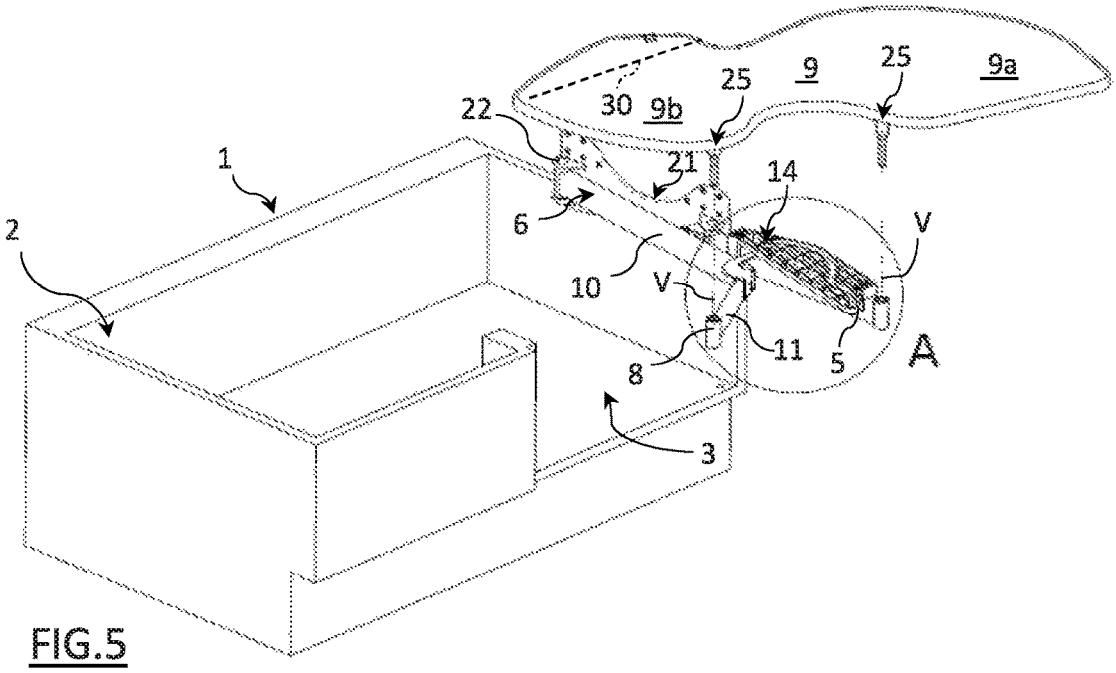
FIGS. 5 and 6 are views corresponding to the views of FIGS. 3 and 4, which show the invention in a condition in which the shelf is practically completely pulled out of the containment space of the cabinet.
Figure 6:
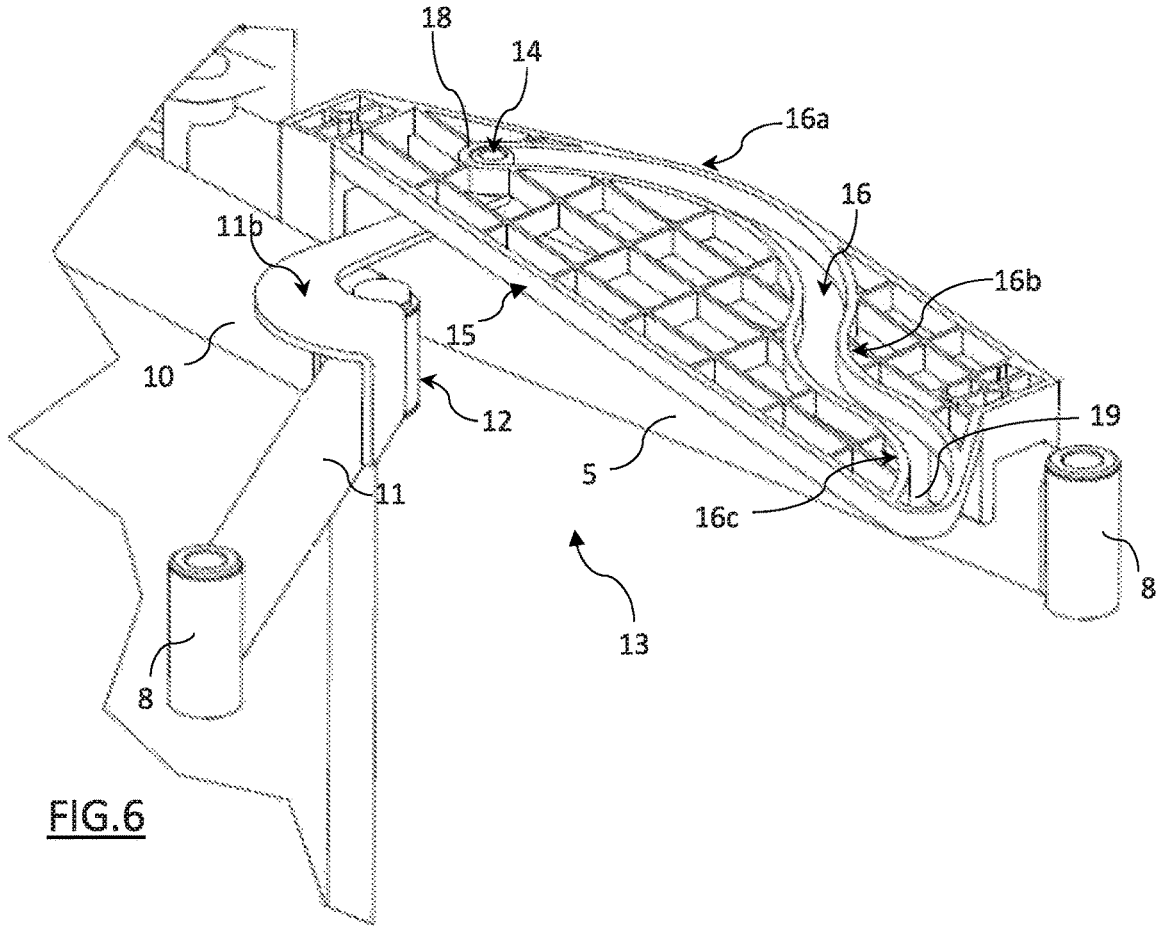

As is clearly shown in FIGS. 5 and 6, the track 16 has closed ends 18 and 19 and has a substantially sinuous shape which, in particular comprises a sequence, preferably of three consecutive sinusoid arcs 16*a*, 16*b*, 16*c* having different lengths and curvatures: which are different and arranged in opposite directions from one arc 16*a*, 16*b*, 16*c* to the next.

In use, as may be inferred by comparing FIGS. 3 and 5, in the relative movement of the slider 14 along the track 16 and in the outward stroke from one end 19 to the other 18 of the track 16, due to activation of the pull-out mechanism 4, the shelf 9 describes—with a law of motion implemented within the geometry of the track 16—rotating and translating kinematics which gradually make it pass through the access opening 3 and practically entirely come out of the containment space 2 of the cabinet 1, without creating any interference with physical parts of the cabinet 1.

During the return stroke, with which the slider 14 travels along the track 16 again with a backward motion, the rotating and translating motion of the shelf 9 is inverted and the shelf 9 goes back into the containment space 2 of the cabinet 1.

Figure 2:
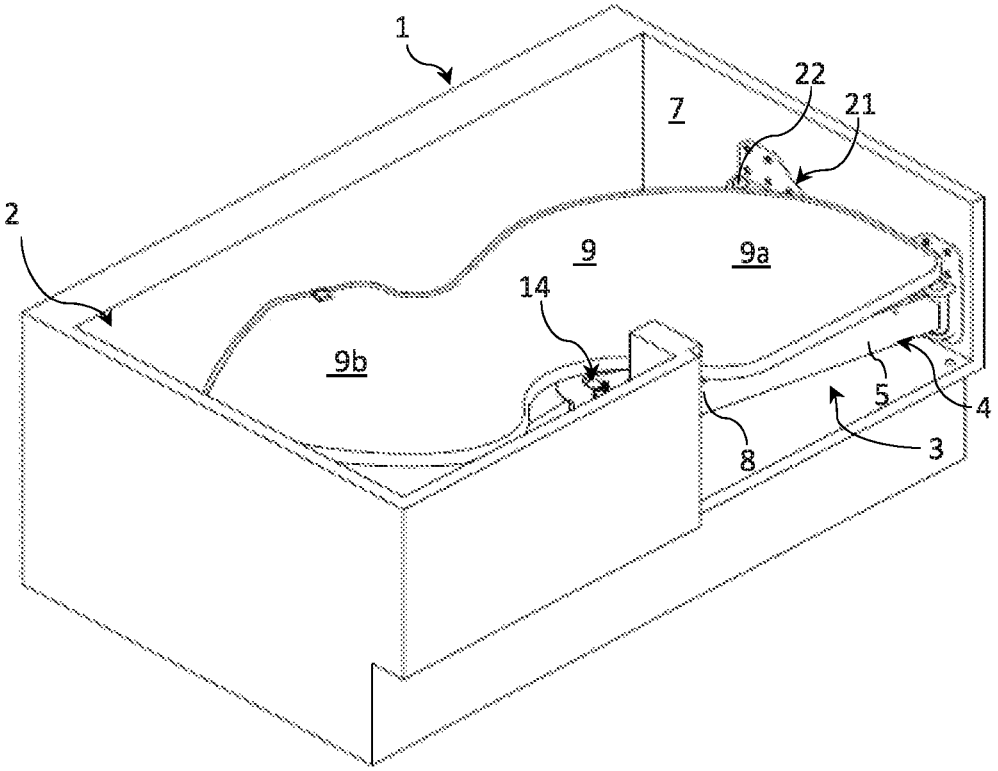
FIG. 2 is a perspective assembly view of the invention of FIG. 1.

In other words, starting from the positioning shown in FIG. 2, in the transition that makes the shelf 9 gradually rotate, initially clockwise and gradually be moved through the access opening 3 (compare FIGS. 3 and 5), the vertex angle between the segments 10 and 11 of the second arm 6 (facing the inside of the cabinet 1) tends to gradually be reduced. Correspondingly, the articulated joint 12 advances, approaching the access opening 3 until it passes through it (FIG. 5). The slider 14 simultaneously approaches the opposite end 18 to that initially affected in FIG. 4.

During continuation of the motion, the shelf 9 itself begins to rotate in the opposite direction to previously, adopting the anti-clockwise direction clearly visible in a comparison of FIGS. 3 and 5. The shelf 9 pulling out movement is completed when the slider 14 reaches the end of stroke of the track 16.

In that final configuration the mechanism 4 has the first arm 5 substantially in contact against the side 7 of the cabinet 1, whilst the jointed second arm 6 is in a condition close to having its component segments 10 and 11 orthogonal to each other.

A comparison of FIGS. 2 and 5 reveals that the mechanism 4 allows the shelf 9 to be placed, by travelling along a horizontal trajectory, with practically identical starting and final positioning for the two end conditions of said trajectory in which the shelf 9 is completely contained in the containment compartment 2 of the cabinet 1, or is pulled out of and so outside the cabinet 1.

It should be noticed, from FIG. 5, that when the shelf 9 is outside the containment space 2, the lobe 9*b* is in reality partly inside and partly outside the access opening 3.

In this state, a benefit is obtained from the dual advantage of allowing the user to have full access to the lobe 9*b*, or to the entire usable surface of the shelf 9, but without having to pay the price of excessive dimensions outside the containment compartment 2, since the extent of the part of the shelf 9 actually projecting outside the cabinet 1 remains less than that of the whole surface of the shelf 9. This is undoubtedly an advantage for modern living spaces which are known to be smaller than those in the past.

However, a comparison of FIGS. 1 and 5 also reveals that the particular shape of the multi-sided edge 9*f*, 9*g* of the outline of the lobe 9*b* allows a greater extent of the usable surface of the lobe 9*b* to be made available. This is at least equal to the mixed-line triangle formed by the edges 9*f* and 9*g* with the dashed line segment 30 shown in FIG. 1.

Therefore, the invention fully achieves the results of the aims previously indicated, bringing multiple advantages such as: a simplified mechanical design, less expensive to produce and highly reliable and long-lasting even with intensive use; reduced dimensions outside the cabinet, but without in any way limiting user access to the whole usable surface of the shelf;

and, all conditions being equal, also providing an extent of the usable surface which is greater than that permitted by similar applications, or a better ratio between the actual usable surface of the pull-out shelf and the theoretical surface of a corresponding, hypothetical, fixed shelf of the receiving cabinet 1. The following are other, equally important advantages of the invention.

The mechanism 4 can be prepared as a modular assembly "kit", which can be mounted quickly and easily, as a whole, on the side 7 of an existing cabinet 1, meaning that a cabinet can be retrofitted with the mechanism in order to accept a movable shelf 9.

The mechanism 4 is also highly versatile in terms of use, with the possibility of specialising depending on the various geometries of the receiving cabinets 1 practically by simply customising the plate 20 with the related track 16.

Moreover, again with reference to versatile use, considering that the mechanism and the related shelf 9 movement induced are irrespective of the width of the access opening 3 of the piece of furniture, it should be noticed that the same mechanism 4 is practically usable for almost the whole range of standard furniture in which, as is known, the width of the access opening usually varies from 450 to 600 mm.

In other words, the horizontal trajectory (which remains invariable) being equal, and the dimensions of the mechanism being equal, in order to switch from one size of furniture to another, only the shape of the shelf 9 needs to be changed.

The invention described above is susceptible of evident industrial application. It may also be modified and adapted in several ways without thereby departing from the scope of the following claims.

Moreover, all details of the invention may be substituted by technically equivalent elements.

The invention claimed is:

1. A cabinet with a containment space (2), shelves (9) contained in the containment space (2), an access opening (3) to the containment space (2) and a moving mechanism (4) for moving the shelves (9) through said opening (3); wherein said moving mechanism (4) comprises a fixed member (21) joined to a side (7) of the cabinet (1) and bearing fixed hinges (22, 23) for rotation about a vertical line (V), a first arm (5) and a second arm (6), which are sustained by the side of the cabinet (1), cantilever-style, inside the containment space (2), and rotatably about the vertical line (V), said first arm (5) and second arm (6) in turn sustaining a related shelf (9) in a condition in which it can rotate, turning about at least the vertical line (V); at least the second arm (6) of said arms (5, 6) being provided with two component segments (10, 11), converging at an interposed articulated joint (12); and control and guiding means (13) for coordination of the movement of said first arm (5) and second arm (6) which are designed to allow the shelf (9) to travel along a horizontal trajectory with variable orientation of its positioning, in such a way that as to pass through the access opening (3) of said cabinet (1); the cabinet (1) being characterised in that said control and guiding means (13) comprise a slider (14) and a track (16) with substantially sinuous extension comprising three arcs (16*a*, 16*b*, 16*c*) arranged facing in opposite directions to one another, relative to which said slider (14) is movable, said slider (14) and said track (16) being as one, constantly coupled to one another, and operatively positioned between said first arm (5) and second arm (6).

2. The cabinet according to claim 1, characterised in that said track (16) is equipped with closed ends (18, 19), forming the ends of stroke of the relative motion of said slider (14) and said track (16).

3. The cabinet according to claim 1, characterised in that said arcs (16*a*, 16*b*, 16*c*) have different lengths.

4. The cabinet according to claim 1, characterised in that said arcs (16*a*, 16*b*, 16*c*) have curvatures that may vary from one to the next.

5. The cabinet according to claim 1, comprising at least one said pull-out shelf (9), characterised in that said shelf (9) is provided with a two-lobe structure (9*a*, 9*b*) with a mixtilinear, sinuous outline, one end of which has a multi-sided shape (9*f*, 9*g*) with at least two straight stretches.

6. A moving mechanism for moving shelves (9) that can be pulled out of a cabinet (1), comprising a fixed member (21), bearing fixed hinges (22, 23) for rotation about a vertical line (V); a first arm (5) and a second arm (6), which are sustained by the fixed member (21), cantilever-style, inside a containment space (2), and rotatably about a vertical line (V), said first arm (5) and second arm (6) in turn sustaining a related shelf (9) in a condition rotatable with a turning motion about at least one vertical line (V); at least the second arm (6) of said arms being provided with two component segments (10, 11), converging at an interposed articulated joint (12); and control and guiding means (13) for coordination of the movement of said first arm (5) and second arm (6) which are designed to allow said shelf (9) to translate along a trajectory with variable orientation of its positioning, in such a way as to allow the shelf (9) to freely pass through the access opening (3) of the cabinet (1); the mechanism (4) being characterised in that said control and guiding means (13) comprise a slider (14) and a track (16) having a substantially sinuous shape, comprising three arcs (16*a*, 16*b*, 16*c*) facing in different directions to one another, relative to which said slider (14) is movable, said slider (14) and said track (16) being as one, constantly coupled to one another and operatively positioned between said first arm (5) and second arm (6).

7. The mechanism according to claim 6, characterised in that said slider (14) is supported by the structure of the articulated joint (12) and said track (16) is supported by said first arm (5).

8. The mechanism according to claim 7, characterised in that said track (16) is equipped with closed ends (18, 19), forming the ends of stroke of the motion of the slider (14) relative to the track (16), where the transition takes place between the outward motion and the return motion, and vice versa, of the shelf (9) through the access opening (3) of the cabinet (1).

9. The mechanism according to claim 6, characterised in that it is made in the form of a pre-assembled set that can be fitted as a whole inside a cabinet (1).

* * * * *